US012326060B2

(12) United States Patent
Novelen et al.

(10) Patent No.: US 12,326,060 B2
(45) **Date of Patent: *Jun. 10, 2025**

(54) WELLBORE ANCHOR INCLUDING ONE OR MORE ACTIVATION CHAMBERS

(71) Applicant: Halliburton Energy Services, Inc., Houston, TX (US)

(72) Inventors: Ryan Michael Novelen, Houston, TX (US); David Symon Grant, Houston, TX (US); Espen Dahl, Stavanger (NO); Morten Falnes, Sola (NO); Gavin Lafferty, Peterhead (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/326,723

(22) Filed: May 21, 2021

(65) Prior Publication Data

US 2022/0372836 A1 Nov. 24, 2022

(51) Int. Cl.

| | |
|---|---|
| ***E21B 33/127*** | (2006.01) |
| ***E21B 17/02*** | (2006.01) |
| ***E21B 23/01*** | (2006.01) |
| ***E21B 23/04*** | (2006.01) |
| ***E21B 43/10*** | (2006.01) |

(52) U.S. Cl.

CPC ..... *E21B 33/1277* (2013.01); *E21B 17/02* (2013.01); *E21B 23/01* (2013.01); *E21B 23/0411* (2020.05); *E21B 43/105* (2013.01); *E21B 43/108* (2013.01)

(58) Field of Classification Search

CPC ..... E21B 33/1277; E21B 17/02; E21B 23/01; E21B 23/0411; E21B 43/105; E21B 43/108

See application file for complete search history.

(56) References Cited

U.S. PATENT DOCUMENTS

| | | | | |
|---|---|---|---|---|
| 1,525,740 A | | 2/1925 | Howard | |
| 2,075,912 A | | 4/1937 | Roye | |
| 2,590,931 A | | 4/1952 | Cabaniss | |
| 2,743,781 A | * | 5/1956 | Lane | E21B 23/01 166/212 |
| 2,865,454 A | | 12/1958 | Richards | |
| 3,206,536 A | | 9/1965 | Goodloe | |

(Continued)

FOREIGN PATENT DOCUMENTS

| | | |
|---|---|---|
| CA | 2820742 A1 | 9/2013 |
| CN | 203308412 U | 11/2013 |

(Continued)

*Primary Examiner* — Robert E Fuller
*Assistant Examiner* — Lamia Quaim
(74) *Attorney, Agent, or Firm* — Scott Richardson; Parker Justiss, P.C.

(57) ABSTRACT

Provided, in one aspect, is an anchor for use with a downhole tool in a wellbore. The anchor, according to this aspect, may include a base pipe; and one or more expandable chambers positioned radially about the base pipe. The one or more expandable chambers may, in some aspects, be configured to move from a first collapsed state to a second activated state; and the one or more expandable chambers may be operable to handle at least 20.7 Bar of internal pressure in the second activated state to engage a wall of a wellbore.

17 Claims, 7 Drawing Sheets

(56) References Cited

U.S. PATENT DOCUMENTS 3,371,716 A 3/1968 Current
3,616,354 A 10/1971 Russell
3,706,125 A 12/1972 Hopkins
4,270,608 A 6/1981 Hendrickson
4,424,859 A 1/1984 Sims
4,424,861 A * 1/1984 Carter, Jr. ..... F16J 15/46 166/212
4,442,908 A 4/1984 Steenbock
4,446,932 A 5/1984 Hipp
4,457,379 A 7/1984 McStravick
4,527,815 A 7/1985 Frick
4,977,636 A 12/1990 King
4,979,585 A 12/1990 Chesnutt
5,139,274 A 8/1992 Oseman
5,220,959 A * 6/1993 Vance, Sr. ..... E21B 33/1277 166/212
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 * 1/2008 Howlett ..... E21B 33/127 166/99
7,347,274 B2 * 3/2008 Patel ..... E21B 33/128 166/120
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 * 6/2011 Kutac ..... E21B 33/1216 166/187
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,276,677 B2 * 10/2012 Ravensbergen ..... E21B 43/114 166/134
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 * 7/2013 Robisson ..... E21B 33/1208 166/387
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
11,708,747 B2 * 7/2023 Dahl ..... E21B 7/061 166/313
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1 6/2009 Corre
2009/0200028 A1 8/2009 Dewar
2009/0250227 A1 10/2009 Brown et al.
2009/0250228 A1 10/2009 Loretz
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1 6/2010 Patel
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1 4/2011 James
2011/0147014 A1 6/2011 Chen et al.

(56) References Cited

U.S. PATENT DOCUMENTS

2012/0018143 A1 1/2012 Lembcke
2012/0048531 A1 3/2012 Marzouk
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson
2012/0273236 A1 11/2012 Gandikota et al.
2013/0048289 A1 2/2013 Mazyar et al.
2013/0056207 A1 3/2013 Wood et al.
2013/0081815 A1 4/2013 Mazyar et al.
2013/0152824 A1 6/2013 Crews
2013/0153236 A1 6/2013 Bishop
2013/0161006 A1 6/2013 Robisson et al.
2013/0186615 A1 7/2013 Hallunbaek et al.
2013/0192853 A1 8/2013 Themig
2013/0292117 A1 11/2013 Robisson
2013/0341005 A1* 12/2013 Bruce ..... E21B 43/02 166/207
2014/0026335 A1 1/2014 Smith
2014/0034308 A1 2/2014 Holderman
2014/0051612 A1 2/2014 Mazyar
2014/0262352 A1 9/2014 Lembcke
2015/0021049 A1 1/2015 Davis et al.
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0258256 A1* 9/2016 Nguyen ..... E21B 34/06
2016/0273312 A1 9/2016 Steele et al.
2016/0319633 A1 11/2016 Cooper et al.
2016/0326830 A1 11/2016 Hallundbaek
2016/0326849 A1* 11/2016 Bruce ..... E21B 23/006
2016/0333187 A1 11/2016 Bauer et al.
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0080304 A1 3/2018 Cortez et al.
2018/0081468 A1 3/2018 Bruce et al.
2018/0086894 A1 3/2018 Roy
2018/0087350 A1 3/2018 Sherman
2018/0094508 A1 4/2018 Smith et al.
2018/0100367 A1 4/2018 Perez
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1* 6/2019 Bruce ..... E21B 34/103
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1 2/2020 Sherman
2020/0072019 A1 3/2020 Onti et al.
2020/0080401 A1 3/2020 Sherman
2020/0080402 A1 3/2020 Lang et al.
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1* 4/2022 Dahl ..... E21B 23/0412
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002
KR 20080096576 A 10/2008
WO 02/02900 A2 1/2002
WO 02/02900 A3 5/2002
WO 02/02900 A8 12/2003
WO 2005/022012 A1 3/2005

(56) References Cited

FOREIGN PATENT DOCUMENTS

| | | | |
|---|---|---|---|
| WO | 2006/045794 | A1 | 5/2006 |
| WO | 2007/047089 | A1 | 4/2007 |
| WO | 2012/094322 | A2 | 7/2012 |
| WO | 2012/125660 | A2 | 9/2012 |
| WO | 2012/094322 | A3 | 10/2012 |
| WO | 2012/125660 | A3 | 2/2013 |
| WO | 2014/028149 | A1 | 2/2014 |
| WO | 2014/182301 | A1 | 11/2014 |
| WO | 2014/193042 | A1 | 12/2014 |
| WO | 2015/057338 | A1 | 4/2015 |
| WO | 2015/069886 | A2 | 5/2015 |
| WO | 2015/069886 | A3 | 9/2015 |
| WO | 2015/183277 | A1 | 12/2015 |
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |

* cited by examiner

WELLBORE ANCHOR INCLUDING ONE OR MORE ACTIVATION CHAMBERS

BACKGROUND

Multilateral wells include one or more lateral wellbores extending from a main wellbore. A lateral wellbore is a wellbore that is diverted from the main wellbore. A multilateral well may include one or more windows or casing exits to allow corresponding lateral wellbores to be formed. The window or casing exits for multilateral wells are typically formed by positioning (e.g., anchoring) one or more whipstock assemblies in a casing string with a running tool at desired locations in the main wellbore. In some embodiments, whipstocks may be used to deflect a window mill relative to the casing string. The deflected window mill penetrates part of the casing joint to form the window or casing exit in the casing string and is then withdrawn from the wellbore. Downhole assemblies can be subsequently inserted through the casing exit in order to cut the lateral wellbore, fracture the lateral wellbore, and/or service the lateral wellbore.

BRIEF DESCRIPTION

Reference is now made to the following descriptions taken in conjunction with the accompanying drawings, in which.

DETAILED DESCRIPTION

Figure 1:
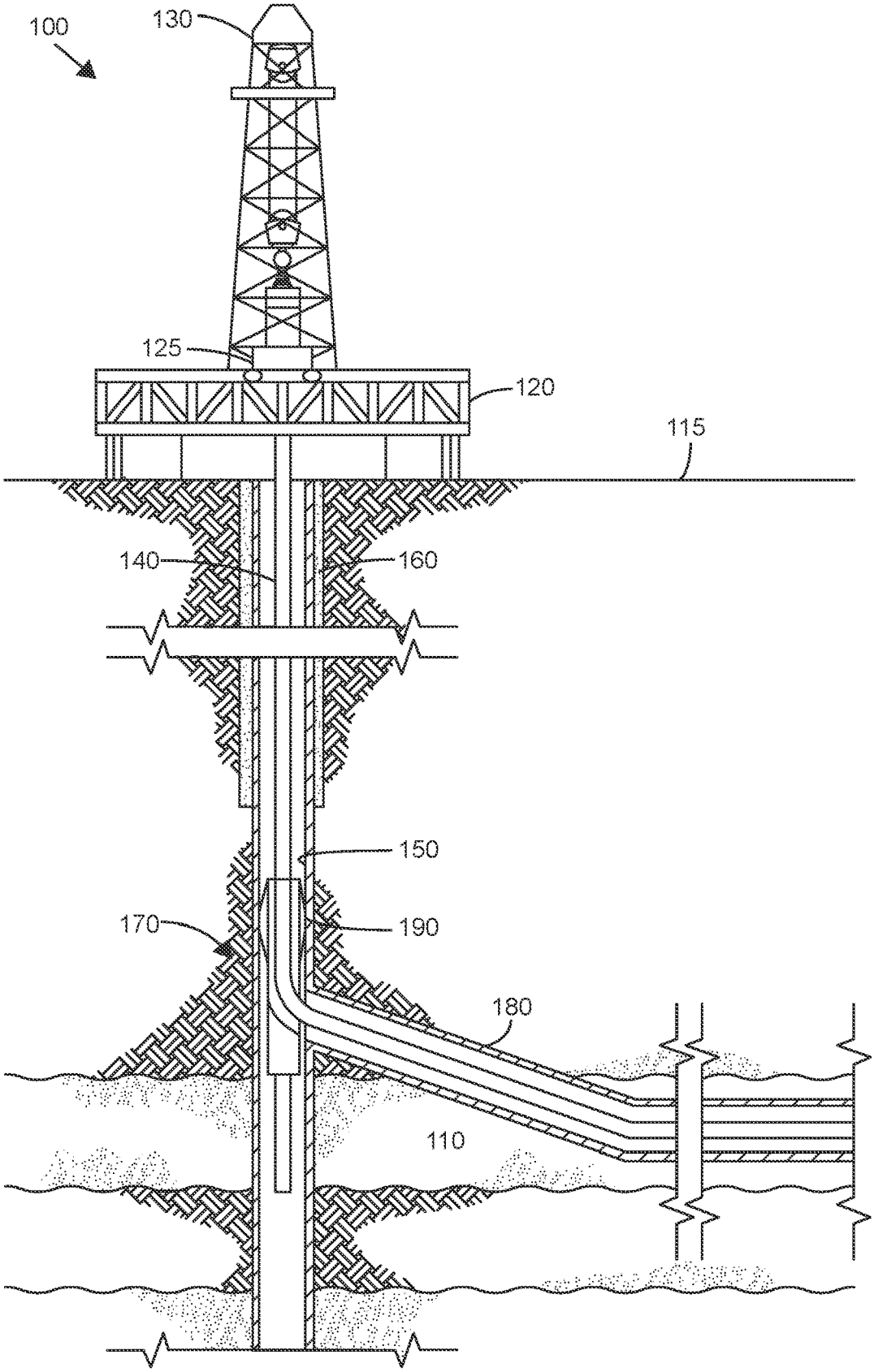
FIG. 1 is a schematic view of a well system according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

FIG. 1 is a schematic view of a well system 100 according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock 170 according to one or more embodiments of the present disclosure may be positioned at a location in the main wellbore 150. Specifically, the whipstock 170 could be placed at a location in the main wellbore 150 where it is desirable for a lateral wellbore 180 to exit. Accordingly, the whipstock 170 may be used to support a milling tool used to penetrate a window in the main wellbore 150, and once the window has been milled and a lateral wellbore 180 formed, in some embodiments, the whipstock 170 may be retrieved and returned uphole by a retrieval tool, in some embodiments in only a single trip.

In some embodiments, an anchor 190 may be placed downhole in the wellbore 150 to support and anchor downhole tools, such as the whipstock 170, for maintaining the whipstock 170 in place while drilling the lateral wellbore 180. The anchor 190, in accordance with the disclosure, may be employed in a cased region of the wellbore 180 or alternatively in an open-hole region of the wellbore 180. As such, the anchor 190 may be configured to resist at least 6,750 newton meters (Nm) (e.g., about 5,000 lb-ft) of torque. In yet another embodiment, the anchor 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the anchor 190 may be configured to resist at least 1814 kg (e.g., about 4,000 lb) of axial force. In yet another embodiment, the anchor 190 may be configured to resist at least 4536 kg (e.g., about 10,000 lb) of axial force, and in yet another embodiment the anchor 190 may be configured to resist at least 6804 kg (e.g., about 15,000 lb) of axial force. The anchor 190 may include, in some aspects, a base pipe and one or more expandable chambers positioned radially about the base pipe. The one or more expandable chambers may be configured to move from a first collapsed state while running in hole, to a second activated state once the anchor is positioned within the wellbore 150.

In some embodiments, the anchor 190 may be hydraulically activated. Once the anchor 190 reaches a desired location in the wellbore 150, fluid pressure may be applied to the one or more expandable chambers to move the one or more expandable chambers from the first collapsed state to the second activated state and engage a wall of the wellbore 150. The anchor 190 may also include, in some embodiments, an exterior sleeve positioned radially about the one or more expandable chambers. In some aspects, the exterior sleeve may be configured to grip and engage the wall of the wellbore 150 when the one or more expandable chambers are in the second activated state.

Figure 2:
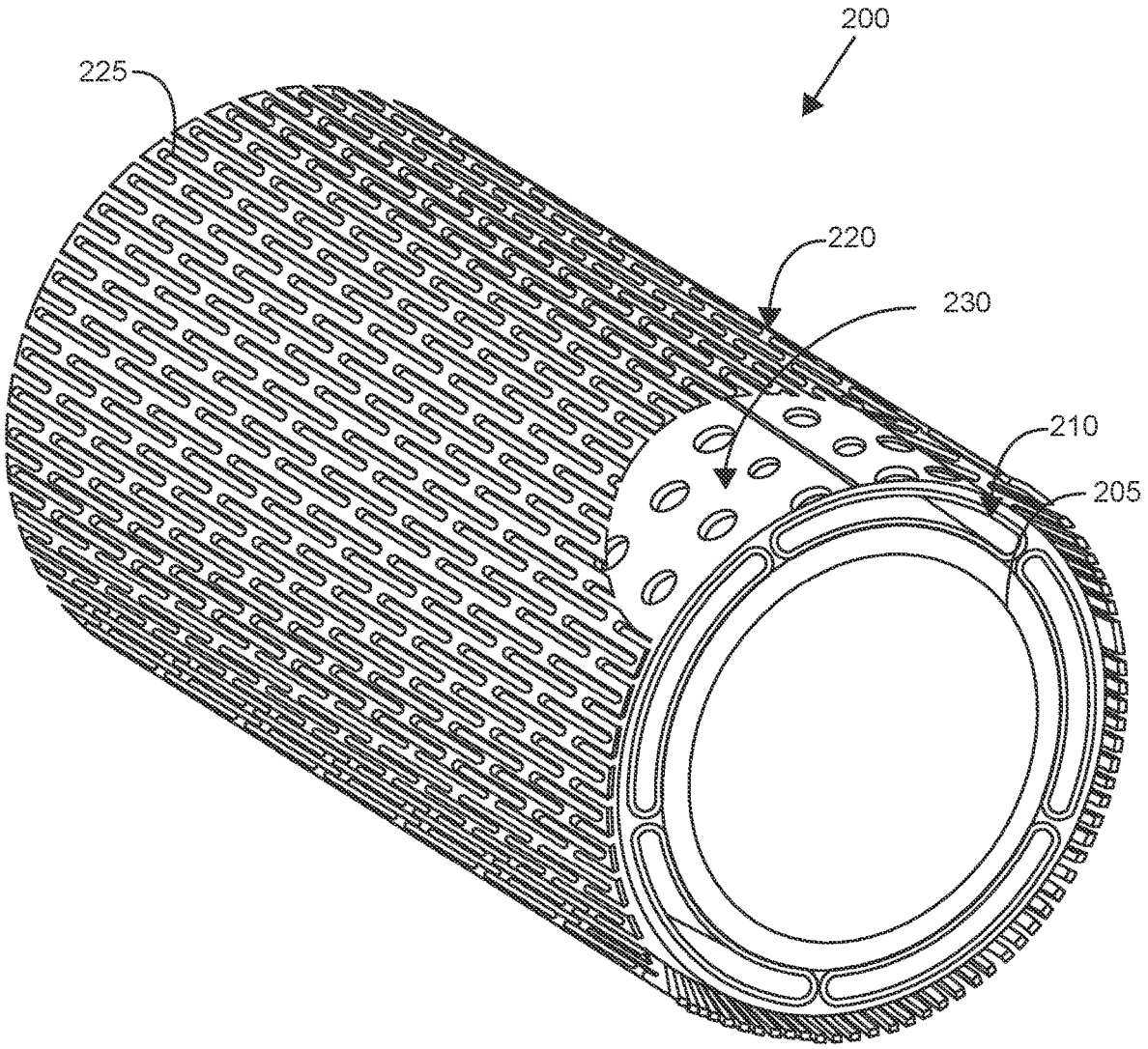
FIGS. 2 and 3 illustrate one embodiment of an anchor designed and manufactured according to one or more embodiments of the disclosure.
Figure 3:
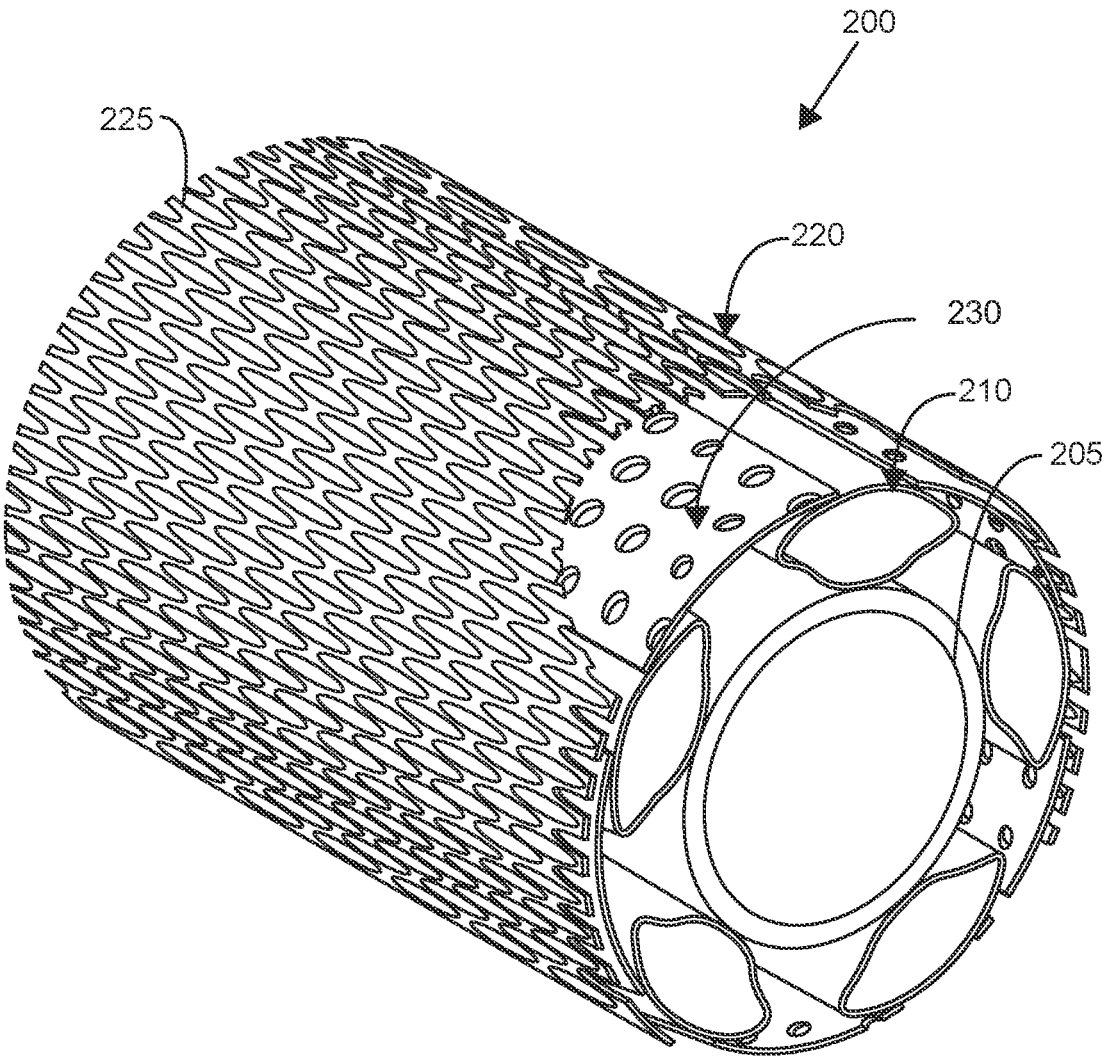

Turning now to FIGS. 2 and 3, illustrated is one embodiment of an anchor 200 designed and manufactured according to one or more embodiments of the disclosure. FIG. 2 illustrates the anchor 200 in the collapsed state, whereas FIG. 3 illustrates the anchor 200 in the activated state. The anchor 200, in one embodiment, may include a base pipe 205. The base pipe 205, in at least on embodiment, does not include openings connecting the interior of the base pipe with the exterior of the base pipe. However, in yet other embodiments, openings may exist between the interior of the base pipe and the exterior of the base pipe.

One or more expandable chambers 210 may be positioned radially about the base pipe 205. In at least one embodiment, one or more full donut shaped expandable chamber 210 is positioned about the base pipe 205. In at least one other embodiment, two or more expandable chambers 210 may be positioned radially about the base pipe 205. In some embodiments the two or more expandable chambers 210 may be generally linearly aligned with one another. As used herein, generally linearly aligned may mean the two or more expandable chambers 210 may be linearly aligned within 10 percent of their length. In other embodiments, the two or more expandable chambers 210 may be substantially linearly aligned with each other, wherein the two or more two or more expandable chambers 210 may be linearly aligned within 5 percent of their length. In still other embodiments, the two or more expandable chambers 210 may be ideally linearly aligned, wherein the two or more two or more expandable chambers 210 may be linearly aligned within 1 percent of their length.

In other embodiments, the two or more expandable chambers may be generally angularly aligned, substantially angularly aligned, or ideally angularly aligned with one another. The term "generally angularly aligned" as used herein, means that the two or more expandable chambers are within 10 degrees of parallel with one another. The term "substantially angularly aligned" as used herein, means that the two or more expandable chambers are within 5 degrees of parallel with one another. The term "ideally angularly aligned" as used herein, means that the two or more expandable chambers are within 2 degrees of parallel with one another.

The two or more expandable chambers 210 may be configured to move from a first collapsed state shown in FIG. 2 to a second activated state shown in FIG. 3 to engage a wall of a wellbore. In some embodiments, when in the second activated state, the one or more expandable chambers 210 may be operable to handle at least 20.7 Bar (about 300 psi) of internal pressure in the second activated state to engage the wall of a wellbore. In some embodiments, when in the second activated state, the one or more expandable chambers 210 may be operable to handle at least 27.6 Bar (about 400 psi) of internal pressure in the second activated state to engage the wall of a wellbore. In some embodiments, when in the second activated state, the one or more expandable chambers 210 may be operable to handle at least 51.7 Bar (about 750 psi) of internal pressure in the second activated state to engage the wall of a wellbore. In some alternative embodiments, when in the second activated state, the one or more expandable chambers 210 may be operable to handle at least 68 Bar (about 1000 psi) of internal pressure in the second activated state to engage the wall of a wellbore.

In some embodiments, the anchor 200 may include an exterior sleeve 220, which may be positioned radially about the two or more expandable chambers 210. In certain embodiments, the exterior sleeve 220 may be configured to split apart or deform as the two or more expandable chambers 210 expand into the second activated state such that the exterior sleeve 220 may thereafter engage and dig into the wall of the wellbore.

The exterior sleeve 220 may include openings 225 therein. The openings 225, in certain embodiments, allow for the exterior sleeve 220 to easily expand. The general size and shape of the openings 225 may vary greatly and remain within the scope of the disclosure. In at least one embodiment, the openings 225 are larger than the opening in a typical sand screen. For example, the openings 225 would have a mesh value of at least about 36 (e.g., 485 μm) or greater. In yet another embodiment, the openings 225 would have a mesh value of at least about 20 (e.g., 850 μm) or greater, or in yet another embodiment the openings 225 would have a mesh value of at least about 10 (e.g., 2,000 μm) or greater.

The exterior sleeve 220, in certain other embodiments, may include a textured surface on an outer surface thereof for engaging the wall of the wellbore. In certain instances, the textured surface has a plurality of undulations, crenellations, corrugations, ridges, depressions, or other surface variations where the radial amplitude of the surface variation is at least about 1 mm (e.g., about 0.04 inches). In yet another embodiment, the radial amplitude of the surface variation is at least about 1.25 mm (e.g., about 0.05 inches), and in yet another embodiment the radial amplitude of the surface variation is between about 1.25 mm (e.g., about 0.06 inches) and about 25 mm (e.g., about 1.0 inches). Any known or hereafter discovered method for creating the textured surface is within the scope of the disclosure.

The exterior sleeve 220 may comprise metals, carbide, polymers, and other materials used in downhole tool applications. In some embodiments, the exterior sleeve 220 may also comprise a swellable elastomer on an outer surface thereof in order to engage and grip the wall of the wellbore once the two or more expandable chamber 210 have been expanded to the second activated state. The swellable elastomer, in some aspects, may be activated by temperature alone, fluid existing in the wellbore, completion fluid inserted in to the wellbore, or any combination of the above. In an alternative embodiment, the swellable elastomer may be activated by a dedicated well treatment run to pump the activation fluid to the swellable elastomer.

In yet other embodiments, the exterior sleeve 220 may comprise an expandable/expanded metal. The expandable metal, in some embodiments, may be chemically activated by reactive fluid (e.g., completion fluid) inserted into the wellbore, and result in expanded metal. The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, assist in preventing extrusion within the sealing assembly. The reaction may, in certain embodiments, occur in less than 2 days in a reactive fluid and in downhole temperatures. Nevertheless, the time of reaction may vary depending on the reactive fluid, the expandable metal used, and the downhole temperature.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal may be machined to any specific size/shape, extruded, formed, cast or other conventional ways to get the desired shape of a metal, as will be discussed in greater detail below. The expandable metal, in certain embodiments has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, CA, etc.) work well for the expandable metal, but transition metals (Al, etc.) also work well for the expandable metal. In one embodiment, the metal hydroxide is dehydrated by the swell pressure to form a metal oxide.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof.

Optionally, non-expanding components may be added to the starting metallic materials. For example, ceramic, elastomer, plastic, epoxy, glass, or non-reacting metal components can be embedded in the expandable metal or coated on the surface of the expandable metal. Alternatively, the starting expandable metal may be the metal oxide. For example, calcium oxide (CaO) with water will produce calcium hydroxide in an energetic reaction. Due to the higher density of calcium oxide, this can have a 260% volumetric expansion (e.g., converting 1 mole of CaO may cause the volume to increase from 9.5 cc to 34.4 cc). In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

In certain embodiments, two or more bridging plates 230 may be positioned radially about the two or more expandable chambers 210. The two or more bridging plates 230 may be configured to extend across at least a gap between outer portions of the two or more expandable chambers 210 when the two or more expandable chambers 210 are in the second activated state as shown in FIG. 3. The two or more bridging plates 230 may be configured, in some aspects to provide support for the exterior sleeve 220 positioned about the two or more expandable chambers 210. While it is illustrated that the two or more bridging plates 230 include openings therein, other embodiments may exist wherein the two or more bridging plates 230 do not include openings therein. Although not shown in the illustrated embodiment, certain embodiments of the two or more bridging plates 230 may include protrusions or a textured surface which may engage the wall of the wellbore, and in some embodiments, the protrusions may extend through openings 225 in the exterior sleeve 220.

Figure 4:
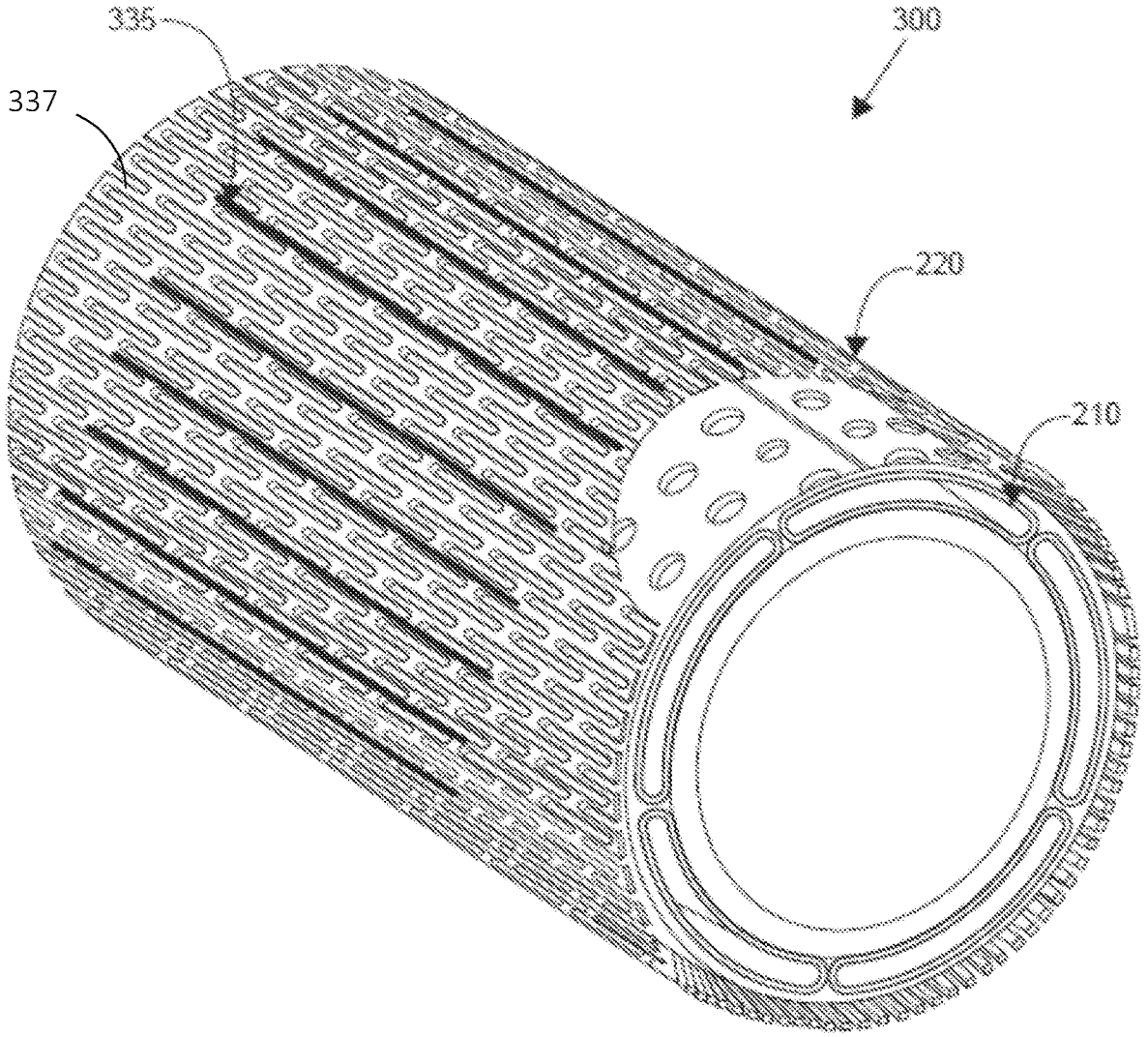
FIGS. 4 and 5 illustrate another embodiment of an anchor designed and manufactured according to one or more embodiments of the disclosure.
Figure 5:
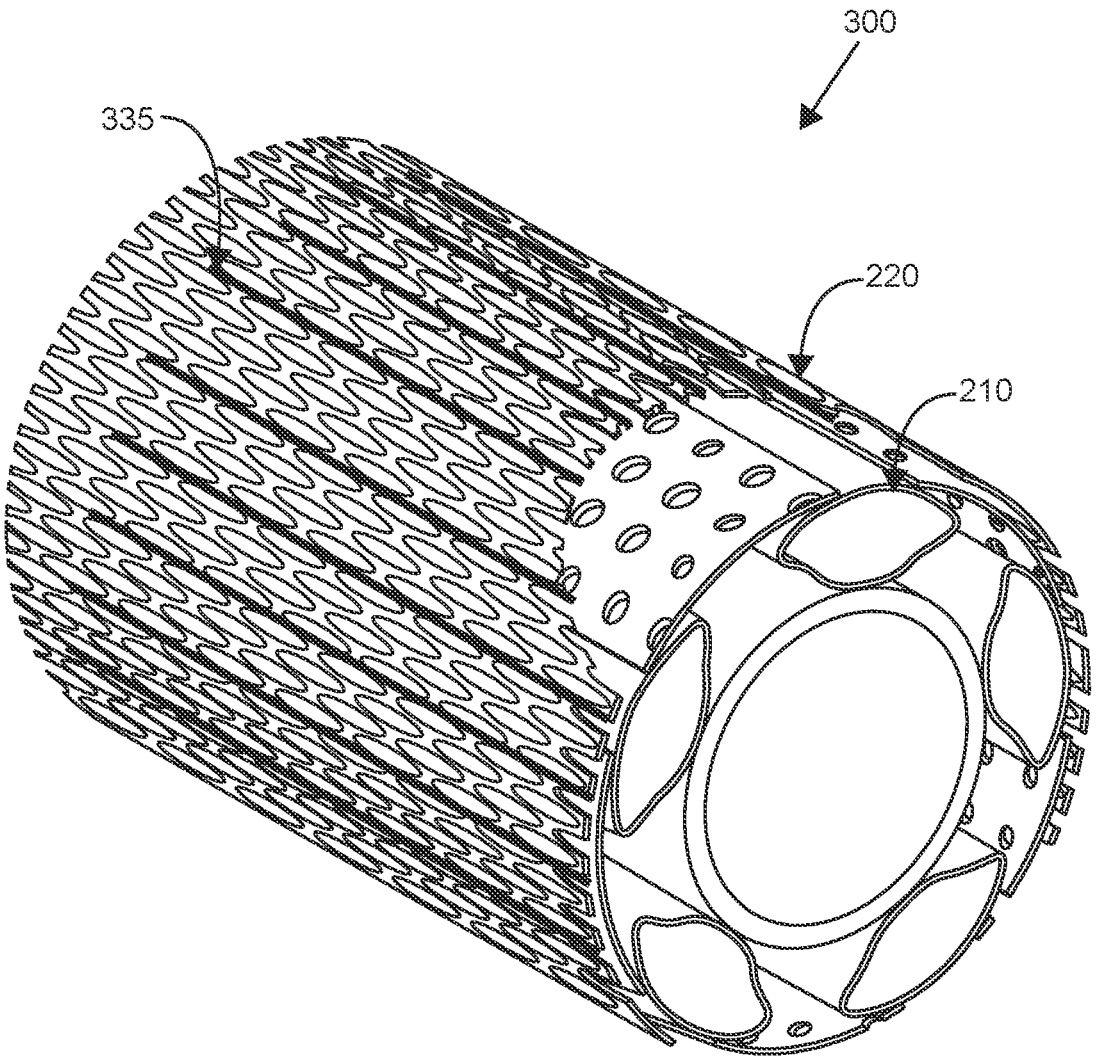

FIGS. 4 and 5 illustrate another embodiment of an anchor 300 designed and manufactured according to one or more embodiments of the disclosure. FIG. 4 illustrates the anchor 300 in the collapsed state, whereas FIG. 5 illustrates the anchor 300 in the activated state. The anchor 300 is similar in many respects to the anchor 200 of FIGS. 2 and 3. Accordingly, like reference numbers have been used to reference similar, if not identical, features. The anchor 300 differs, for the most part, from the anchor 200, in that one embodiment of an exterior sleeve 220 may include protrusions 335 on an outer surface 337 thereof for engaging a wall of a wellbore. As the two or more expandable chambers 210 are expanded to the second activated state, as shown in FIG. 5, the exterior sleeve 220 moves radially outward toward the wall of the wellbore and the protrusions 335 may grip into and engage the wall of the wellbore.

Figure 6:
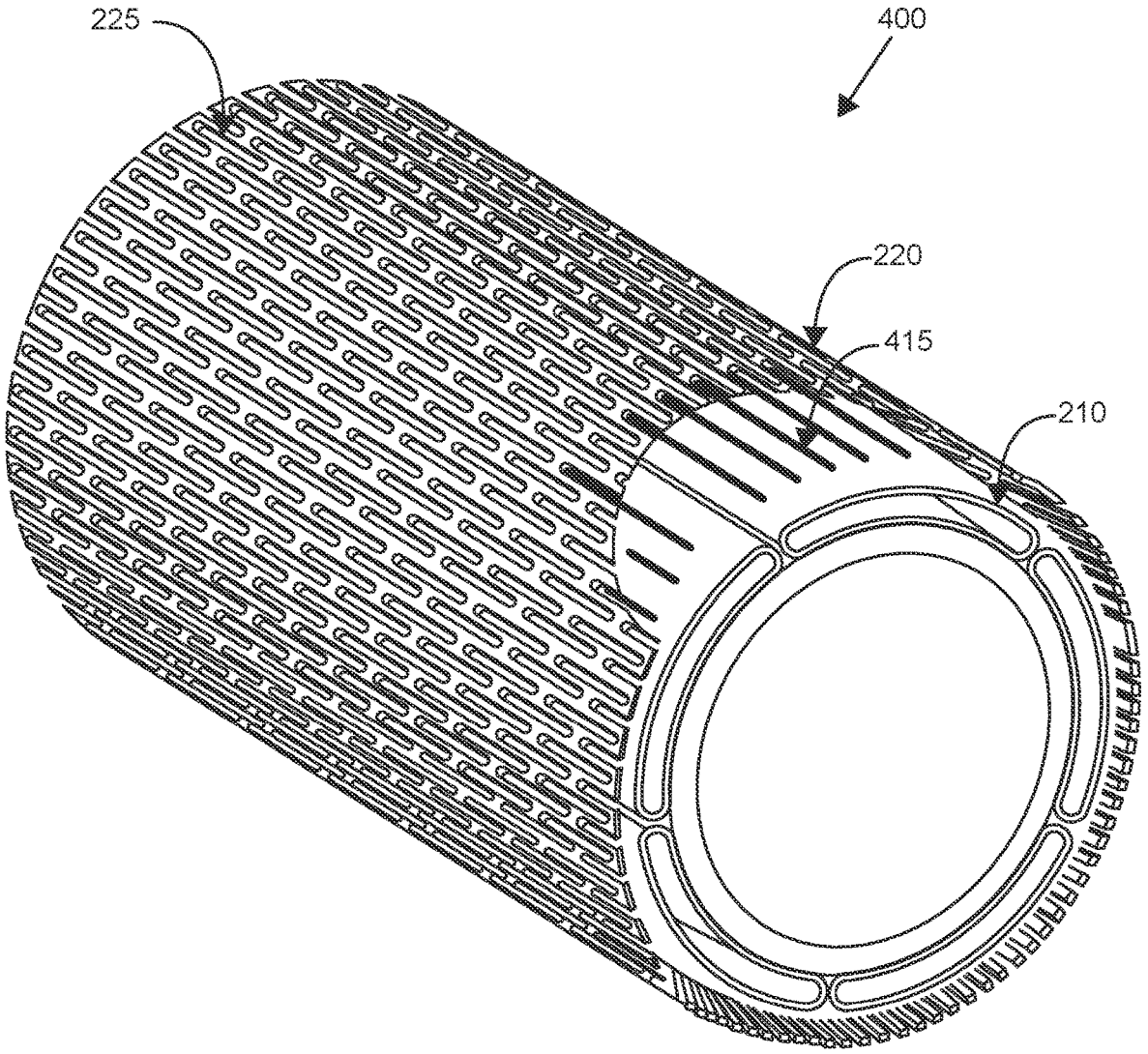
FIGS. 6 and 7 illustrate yet another embodiment of an anchor designed and manufactured according to one or more embodiments of the disclosure.
Figure 7:
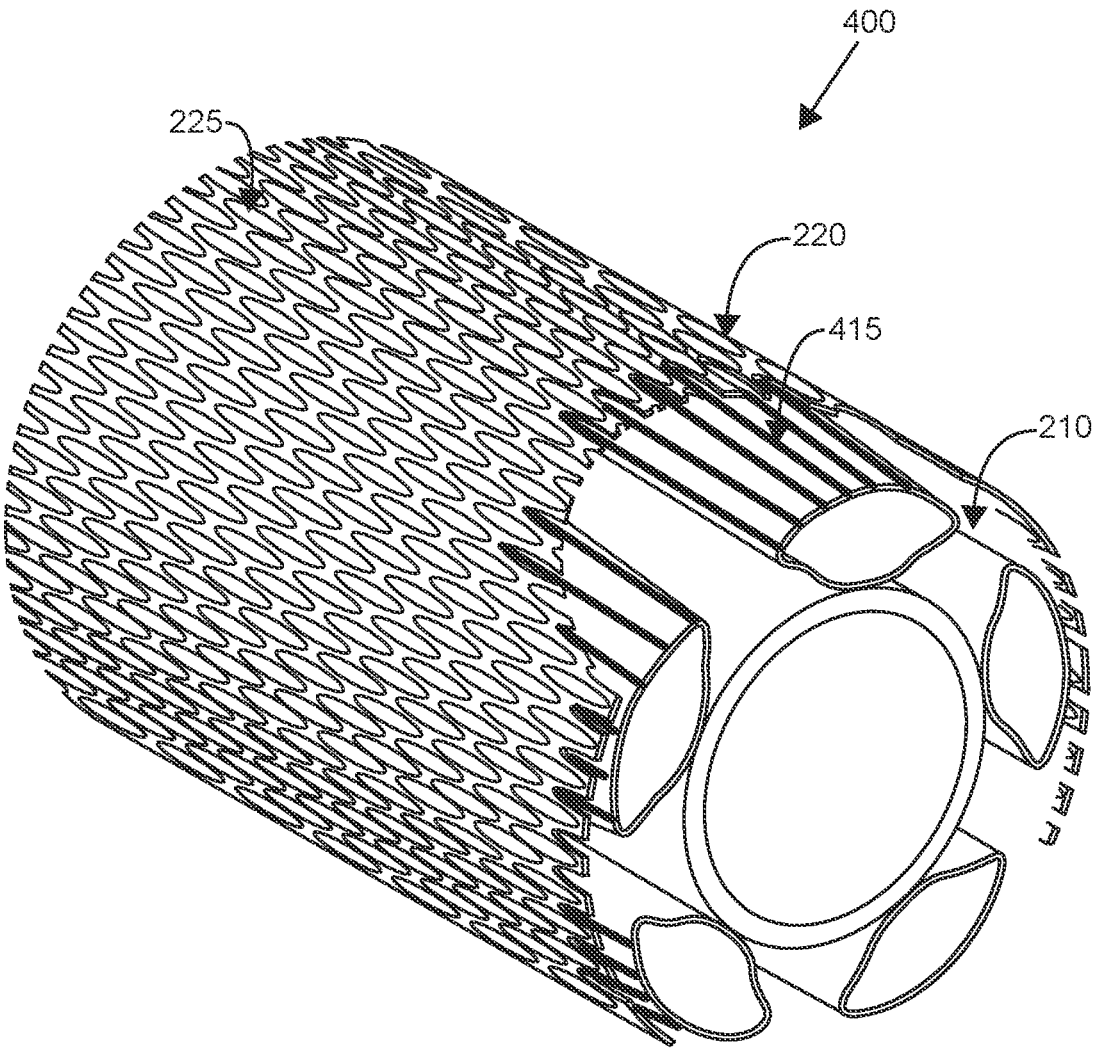

FIGS. 6 and 7 illustrate another embodiment of an anchor 400 designed and manufactured according to one or more embodiments of the disclosure. FIG. 6 illustrates the anchor 400 in the collapsed state, whereas FIG. 7 illustrates the anchor 400 in the activated state. The anchor 400 is similar in many respects to the anchor 200 of FIGS. 2 and 3. Accordingly, like reference numbers have been used to reference similar, if not identical, features. The anchor 400 differs, for the most part, from the anchor 200, in that in this embodiment the two or more expandable chambers 210 may include protrusions 415 on an outer circumference thereof. The protrusions 415 may engage the wall of the wellbore as the two or more expandable chambers 210 are expanded outward to the second activated state, as shown in FIG. 7. In some embodiments, the protrusions 415 on the outer circumference of the two or more expandable chambers 210 may be configured to protrude through the openings 225 in the exterior sleeve 220 positioned radially about the two or more expandable chambers 210.

Certain embodiments of an anchor disclosed herein may be constructed and function similar to endurance hydraulic screens (EHS) used in wellbore applications. However, anchors according to one or more embodiments of the disclosure may not need to provide any sand or debris control generally required by EHS and as such, may not include any filter mediums or screen members. For example, the anchor may not include any screen members having a filter medium having a size less than 500 micron.

Aspects disclosed herein include:

A. An anchor for use with a downhole tool in a wellbore, the anchor including: 1) a base pipe; and 2) one or more expandable chambers positioned radially about the base pipe; 3) wherein the one or more expandable chambers are configured to move from a first collapsed state to a second activated state; and 4) wherein the one or more expandable chambers are operable to handle at least 20.7 Bar of internal pressure in the second activated state to engage a wall of a wellbore.

B. A method for anchoring a downhole tool in a wellbore, the method including: 1) running a downhole tool including an anchor into a wellbore, the anchor including: a) a base pipe; b) one or more expandable chambers positioned radially about the base pipe; c) wherein the one or more expandable chambers are configured to move from a first collapsed state to a second activated state; and d) wherein the one or more expandable chambers are operable to handle at least 20.7 Bar of internal pressure in the second activated state to engage a wall of the wellbore; and 2) applying fluid pressure to the one or more expandable chambers to move the one or more expandable chambers from the first collapsed state to the second activated state and anchor the downhole tool within the wellbore.

C. A well system, the well system including: 1) a wellbore; and 2) a downhole tool including an anchor positioned within the wellbore, the at least one anchor including: a) a base pipe; b) one or more expandable chambers positioned radially about the base pipe; c) wherein the one or more expandable chambers are configured to move from a first collapsed state to a second activated state; and d) wherein the one or more expandable chambers are operable to handle at least 20.7 Bar of internal pressure in the second activated state to engage a wall of a wellbore.

Aspects A, B, and C may have one or more of the following additional elements in combination: Element 1: wherein the one or more expandable chambers are two or more expandable chambers positioned radially about the base pipe, the two or more expandable chambers generally linearly aligned with one another. Element 2: further comprising an exterior sleeve positioned radially about the two or more expandable chambers. Element 3: wherein the exterior sleeve includes protrusions on an outer surface thereof for engaging the wall of the wellbore. Element 4: wherein the exterior sleeve includes a textured surface on an outer surface thereof for engaging the wall of the wellbore. Element 5: wherein the exterior sleeve comprises a swellable elastomer on an outer surface thereof. Element 6: wherein exterior sleeve comprises an expandable metal. Element 7: wherein the two or more expandable chambers include protrusions on an outer circumference thereof, the protrusions for engaging the wall of the wellbore. Element 8: wherein the protrusions on the outer circumference of the two or more expandable chambers are configured to protrude through openings in an exterior sleeve positioned radially about the two or more expandable chambers. Element 9: further comprising two or more bridging plates positioned radially about the two or more expandable chambers, wherein the two or more bridging plates are configured to extend across at least a gap between outer portions of the two or more expandable chambers in the second activated state. Element 10: wherein the anchor does not include a screen member having a filter medium having a size less than 36 mesh. Element 11: wherein the one or more expandable chambers are two or more expandable chambers positioned radially about the base pipe, the two or more expandable chambers generally linearly aligned with one another. Element 12: wherein the anchor further includes an exterior sleeve positioned radially about the two or more expandable chambers. Element 13: wherein the exterior sleeve includes protrusions on an outer surface thereof for engaging the wall of the wellbore. Element 14: wherein the two or more expandable chambers include protrusions on an outer circumference thereof, the protrusions for engaging the wall of the wellbore. Element 15: wherein the protrusions on the outer circumference of the two or more expandable chambers are configured to protrude through openings in an exterior sleeve positioned radially about the two or more expandable chambers. Element 16: further comprising two or more bridging plates positioned radially about the two or more expandable chambers, wherein the two or more bridging plates are configured to extend across at least a gap between outer portions of the two or more expandable chambers in the second activated state. Element 17: wherein the one or more expandable chambers are two or more expandable chambers positioned radially about the base pipe, the two or more expandable chambers generally linearly aligned with one another. Element 18: wherein the anchor further includes an exterior sleeve positioned radially about the two or more expandable chambers. Element 19: wherein the exterior sleeve includes protrusions on an outer surface thereof for engaging the wall of the wellbore. Element 20: wherein the exterior sleeve includes a textured surface on an outer surface thereof for engaging the wall of the wellbore. Element 21: wherein the two or more expandable chambers include protrusions on an outer circumference thereof, the protrusions for engaging the wall of the wellbore and wherein the protrusions on the outer circumference of the two or more expandable chambers are configured to protrude through openings in an exterior sleeve positioned radially about the two or more expandable chambers. Element 22: wherein the anchor further includes two or more bridging plates positioned radially about the two or more expandable chambers, wherein the two or more bridging plates are configured to extend across at least a gap between outer portions of the two or more expandable chambers in the second activated state.

Those skilled in the art to which this application relates will appreciate that other and further additions, deletions, substitutions and modifications may be made to the described embodiments.

What is claimed is:

1. An anchor for use with a downhole tool in a wellbore, comprising:

a base pipe;

two or more expandable chambers positioned radially about the base pipe;

wherein the two or more expandable chambers are configured to move from a first collapsed state to a second fixed activated state; and wherein the two or more expandable chambers are operable to handle at least 20.7 Bar of internal pressure in the second activated state to engage a wall of the wellbore, are generally linearly aligned with one another, include protrusions on an outer surface thereof, the protrusions configured to protrude through openings in an exterior sleeve positioned radially about the two or more expandable chambers for engaging the wall of the wellbore, and further wherein the base pipe does not include openings therein radially inside of the two or more expandable chambers.

2. The anchor according to claim 1, further comprising an exterior sleeve positioned radially about the two or more expandable chambers.

3. The anchor according to claim 2, wherein the exterior sleeve includes protrusions on an outer surface thereof for engaging the wall of the wellbore.

4. The anchor according to claim 2, wherein the exterior sleeve includes a textured surface on an outer surface thereof for engaging the wall of the wellbore.

5. The anchor according to claim 2, wherein the exterior sleeve comprises a swellable elastomer on an outer surface thereof.

6. The anchor according to claim 2, wherein the exterior sleeve comprises an expandable metal.

7. The anchor according to claim 1, further comprising two or more bridging plates positioned radially about the two or more expandable chambers, wherein the two or more bridging plates are configured to extend across at least a gap between outer portions of the two or more expandable chambers in the second activated state.

8. The anchor according to claim 1, wherein the anchor does not include a screen member having a filter medium having a size less than 36 mesh.

9. A method for anchoring a downhole tool in a wellbore, the method comprising:

running the downhole tool including an anchor into the wellbore, the anchor including:

a base pipe;

two or more expandable chambers positioned radially about the base pipe;

wherein the two or more expandable chambers are configured to move from a first collapsed state to a second activated state; and wherein the two or more expandable chambers are operable to handle at least 20.7 Bar of internal pressure in the second activated state to engage a wall of the wellbore, are generally linearly aligned with one another, include protrusions on an outer surface thereof, the protrusions configured to protrude through openings in an exterior sleeve positioned radially about the two or more expandable chambers for engaging the wall of the wellbore, and further wherein the base pipe does not include openings therein radially inside of the two or more expandable chambers; and applying fluid pressure to the two or more expandable chambers to move the one or more expandable chambers from the first collapsed state to the second activated state and anchor the downhole tool within the wellbore.

10. The method according to claim 9, wherein the anchor further includes an exterior sleeve positioned radially about the two or more expandable chambers.

11. The method according to claim 10, wherein the exterior sleeve includes protrusions on an outer surface thereof for engaging the wall of the wellbore.

12. The method according to claim 9, further comprising two or more bridging plates positioned radially about the two or more expandable chambers, wherein the two or more bridging plates are configured to extend across at least a gap between outer portions of the two or more expandable chambers in the second activated state.

13. A well system, comprising:

a wellbore; and a downhole tool including an anchor positioned within the wellbore, the at least one anchor including:

a base pipe;

two or more expandable chambers positioned radially about the base pipe;

wherein the two or more expandable chambers are configured to move from a first collapsed state to a second activated state; and wherein the two or more expandable chambers are operable to handle at least 20.7 Bar of internal pressure in the second activated state to engage a wall of the wellbore, are generally linearly aligned with one another, include protrusions on an outer surface thereof, the protrusions configured to protrude through openings in an exterior sleeve positioned radially about the two or more expandable chambers for engaging the wall of the wellbore, and further wherein the base pipe does not include openings therein radially inside of the two or more expandable chambers.

14. The well system according to claim 13, wherein the anchor further includes an exterior sleeve positioned radially about the two or more expandable chambers.

15. The well system according to claim 14, wherein the exterior sleeve includes protrusions on an outer surface thereof for engaging the wall of the wellbore.

16. The well system according to claim 14, wherein the exterior sleeve includes a textured surface on an outer surface thereof for engaging the wall of the wellbore.

17. The well system according to claim 13, wherein the anchor further includes two or more bridging plates positioned radially about the two or more expandable chambers, wherein the two or more bridging plates are configured to extend across at least a gap between outer portions of the two or more expandable chambers in the second activated state.

* * * * *